US008104103B2

(12) United States Patent
Han

(10) Patent No.: US 8,104,103 B2
(45) Date of Patent: Jan. 31, 2012

(54) TOILET FLAPPER FLUSH VALVE ASSEMBLY

(75) Inventor: Joseph Han, Irvine, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 664 days.

(21) Appl. No.: 12/315,055

(22) Filed: Nov. 26, 2008

(65) Prior Publication Data

US 2009/0144888 A1 Jun. 11, 2009

Related U.S. Application Data

(60) Provisional application No. 61/005,838, filed on Dec. 7, 2007, provisional application No. 61/005,713, filed on Dec. 7, 2007.

(51) Int. Cl.
*E03D 1/35* (2006.01)

(52) U.S. Cl. ..... 4/393; 4/378; 4/392

(58) Field of Classification Search ..... 4/378, 385, 4/386, 392, 393, 661; 251/298; 29/428
See application file for complete search history.

(56) References Cited

U.S. PATENT DOCUMENTS

| | | | | |
|---|---|---|---|---|
| 2,779,028 | A * | 1/1957 | Branch | 4/393 |
| 2,970,319 | A | 2/1961 | Lassiter | |
| 4,698,859 | A * | 10/1987 | Freed | 4/393 |
| 5,090,066 | A * | 2/1992 | Schoepe et al. | 4/378 |
| 7,636,958 | B2 * | 12/2009 | Nichols-Roy et al. | 4/378 |
| 2006/0185068 | A1 | 8/2006 | Halloran et al. | |
| 2006/0218712 | A1 | 10/2006 | Nichols-Roy et al. | |
| 2006/0261239 | A1 | 11/2006 | Courbon | |
| 2007/0163972 | A1 | 7/2007 | Sopel | |

FOREIGN PATENT DOCUMENTS

CN 2421342 Y 2/2001

OTHER PUBLICATIONS

PCT International Search Report, Jan. 13, 2009.
Emtek Brass Bathroom Accessories, http://www.directdoorhardware.com/Emtek/Bath-Accessories/Brass.htm.

* cited by examiner

*Primary Examiner* — Basil Katcheves
*Assistant Examiner* — Patrick Maestri
(74) *Attorney, Agent, or Firm* — Gordon & Rees LLP

(57) ABSTRACT

A flapper flush valve assembly includes a pair of laterally movable mounting arms which may be adjusted to vary a width therebetween to accommodate overflow tubes of different sizes. The flapper valve assembly is coupled to pivot members connected to an overflow tube. Mounting ears on the pivot members may include projections to provide spacing between the rotating mounting arms and adjacent sidewall of a toilet tank, thereby preventing jams.

11 Claims, 8 Drawing Sheets

TOILET FLAPPER FLUSH VALVE ASSEMBLY

RELATED APPLICATIONS

This application relates to, claims priority from, and incorporates herein by reference, as if fully set forth, U.S. Provisional Patent Application Ser. No. 61/005,838 filed on Dec. 7, 2007 and entitled "FLAPPER JAM PREVENTION DEVICE" and U.S. Provisional Patent Application Ser. No. 61/005,713 filed on Dec. 7, 2007 and entitled "ADJUSTABLE FLAPPER ARM."

BACKGROUND OF THE INVENTION

1. Field of the Invention

The present invention relates generally to toilet flush valves.

2. Description of Prior Art and Related Information

Conventional toilet flapper valves are susceptible to a variety of shortfalls. Since the flapper valves are typically manufactured according to exact specifications, a particular flapper valve may only be used with a specifically sized overflow tube. Flapper valves according to the prior art are also typically installed next to the rear vertical wall of toilet tanks. Rotation of the conventional flapper valves in response to flushes causes the mounting ears to rotate. Depending upon the distance between the rotating mounting ears and the toilet tank wall, a conventional flapper valve can get stuck in the open position as the mounting ears abut the vertical wall. This leads to excessive water loss as well as the need to manually close the flapper valve.

SUMMARY OF THE INVENTION

The present invention provides structures and methods which overcome the deficiencies in the prior art.

In one aspect, a flush valve assembly is provided. The assembly comprises a flapper portion coupled to a pivot member and rotatable with respect to a valve seat. A first mounting arm and second mounting arm are coupled to the flapper portion and the pivot member. The first mounting arm is adjustable with respect to the second mounting arm so as to vary a distance, or width, therebetween.

The first mounting arm comprises a first tab. The second mounting arm comprises a second tab. The flapper portion comprises a first opening for receiving the first tab and a second opening for receiving the second tab. The flapper portion comprises a first detent for locating the first mounting in a first fixed position, and a second detent for locating the second mounting arm in a second fixed position. The the second mounting arm may also be adjustable with respect to the first mounting arm. The flapper portion has a top planar wall that defines a plane. The first mounting arm is movable with respect to the second mounting arm in a direction parallel to the plane. The pivot member comprises a mounting ear having an extension.

In another aspect, a flush valve assembly comprises a pivot member coupled to an overflow tube and a flapper portion coupled to the pivot member and rotatable with respect to a valve seat. At least one extension member is coupled to the pivot member to space the flapper portion away from a vertical sidewall of a toilet tank.

The pivot member comprises a first axle and a second axle. A first extension member comprises a first mounting ear coupled to the first axle, the first mounting ear having a first extension. A second mounting ear is coupled to the second axle, the second mounting ear having a second extension. The assembly comprises a pair of mounting arms coupled to the flapper portion and the pivot member. Each mounting arm is preferably adjustable with respect to the other so as to vary a distance therebetween.

In another aspect, a method for installing a flush valve is provided. The method comprises providing a flapper valve with a first mounting arm and a second mounting arm, adjusting the first mounting arm to vary a distance between the first mounting arm and the second mounting arm, and coupling the first mounting arm and the second mounting arm to a pivot. The method further comprises preventing the mounting arms from contacting a sidewall of a toilet tank when rotating. The step of preventing the mounting arms from contacting the sidewall of the toilet tank when rotating comprises providing an extension on a mounting ear of the pivot.

The method also includes retrofitting an existing flush valve assembly and thus further comprises removing an existing flapper valve from an existing overflow tube. The step of coupling the first mounting arm and the second mounting arm to the pivot comprises coupling the first mounting arm and the second mounting arm to the pivot connected to the existing overflow tube.

In summary, a flapper flush valve assembly includes a pair of laterally movable mounting arms which may be adjusted to vary a width therebetween to accommodate overflow tubes of different sizes. The flapper valve assembly is coupled to pivot members connected to an overflow tube. Mounting ears on the pivot members may include projections to provide spacing between the rotating mounting arms and adjacent sidewall of a toilet tank, thereby preventing jams.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
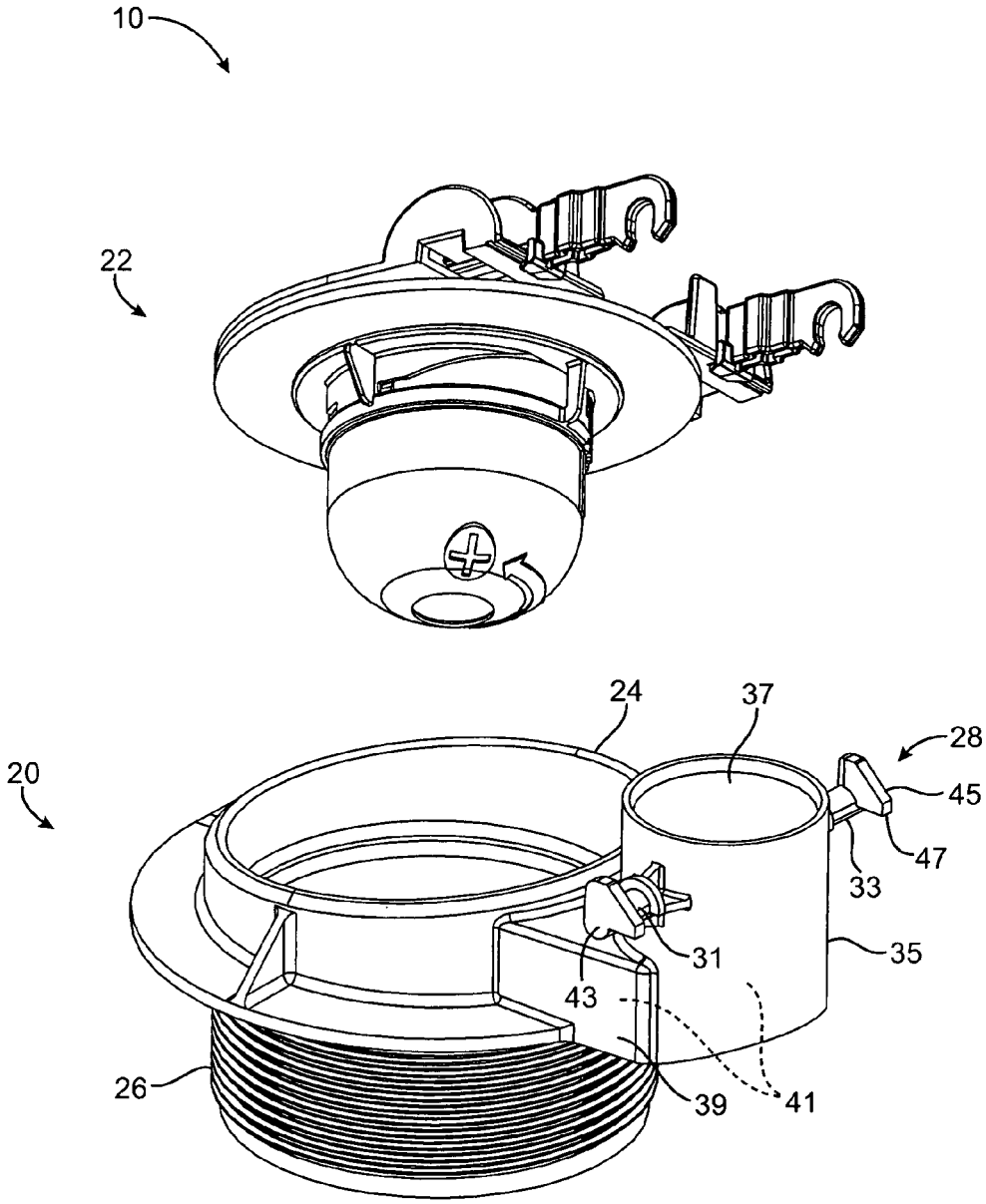
FIG. 1 is an exploded view of a preferred embodiment of a flapper valve assembly.

In FIG. 1, a preferred embodiment of a flush valve assembly is illustrated and designated generally by the reference numeral 10. The assembly 10 comprises a flush valve body 20 and a flapper apparatus, or simply flapper, 22. The valve body 20 comprises a valve seat 24 and an externally threaded cylinder 26 extending downwardly therefrom. A pivot 28 comprises first and second axles 31, 33 extending horizontally from a conduit 35 with an open top 37 configured to be coupled to an overflow tube. The conduit 35 and a horizontal tube 39 collectively define a passageway 41 that is in fluid communication with the cylinder 26. Each axle 31, 33 includes a corresponding mounting ear 43, 45 disposed at an outer end.

Figure 2:
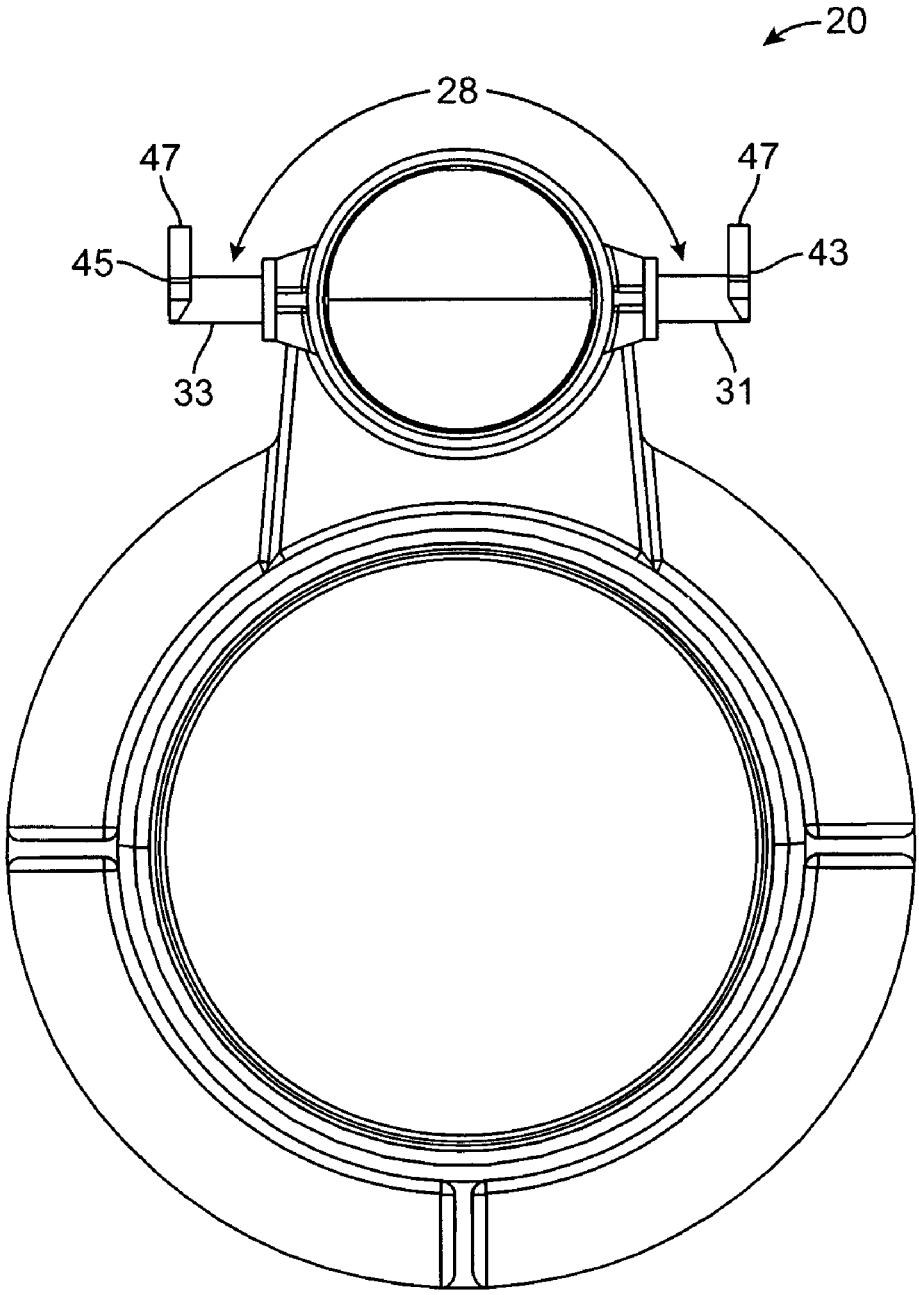
FIG. 2 is a top view of the preferred flush valve body.
Figure 3:
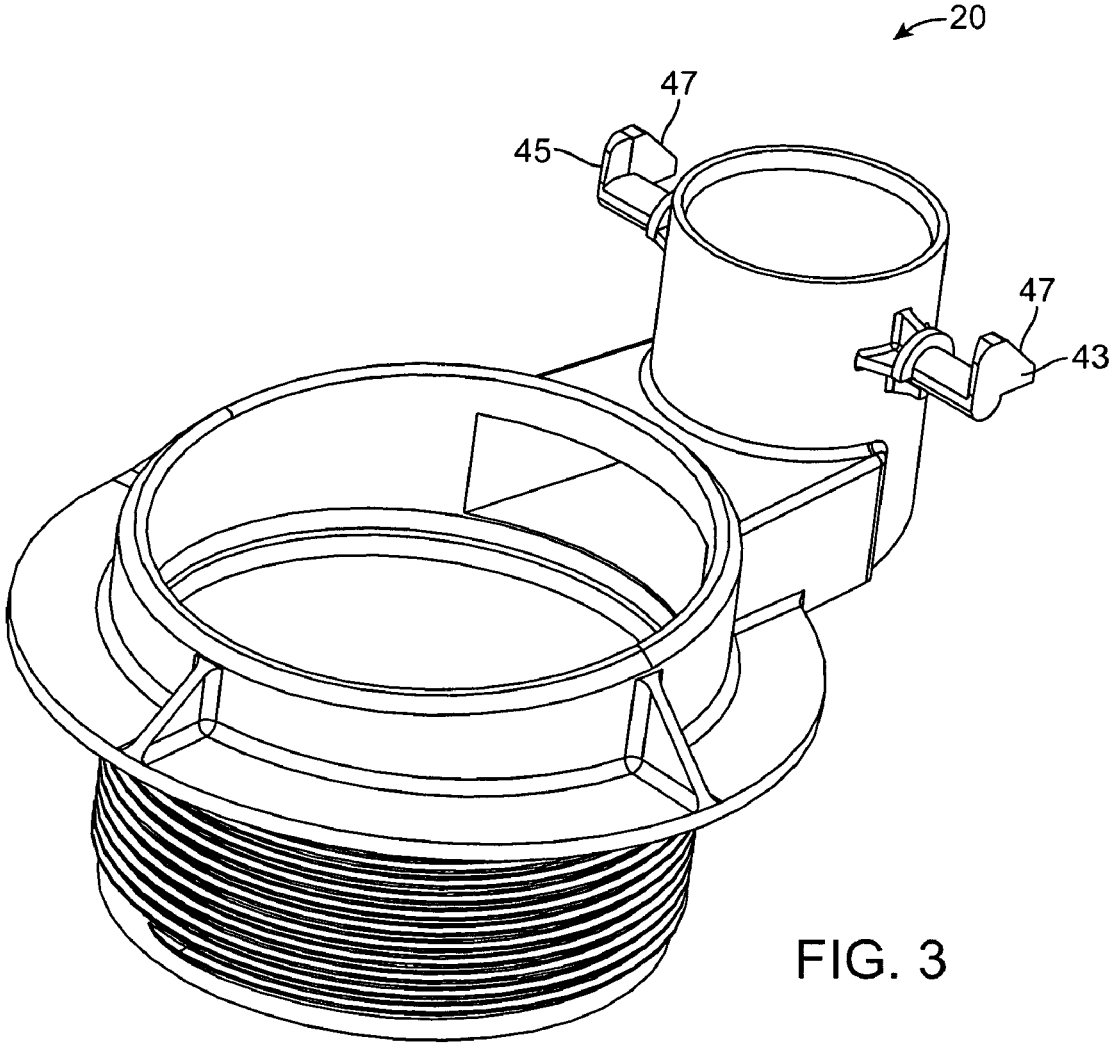
FIG. 3 is a perspective view of a preferred flush valve body.

In FIGS. 1-3, each mounting ear 43, 45 includes a rearwardly extending protrusion, or extension, 47 configured to project rearwardly and abut an adjacent toilet tank sidewall so as to provide space between the sidewall and the axles 31, 33. The preferred flush valve body 20 may be used with conventional flappers or with the preferred flapper 22 according to a preferred embodiment of the invention. The extended mounting ears 43, 45 prevent the mounting arms of flappers from getting jammed against an adjacent sidewall of the toilet tank, particularly when a flush is activated and the flapper is in the open position. When jammed, excess water continues to flow into the toilet tank. Thus, the water conservation benefits of preventing flapper jams will be appreciated as the preferred flush valve body 20 prevents a significant amount of water from being wasted through an otherwise jammed flapper. The preferred flush valve body 20 also prevents the inconvenience of a user having to open a toilet lid and manually closing the flapper.

Figure 4:
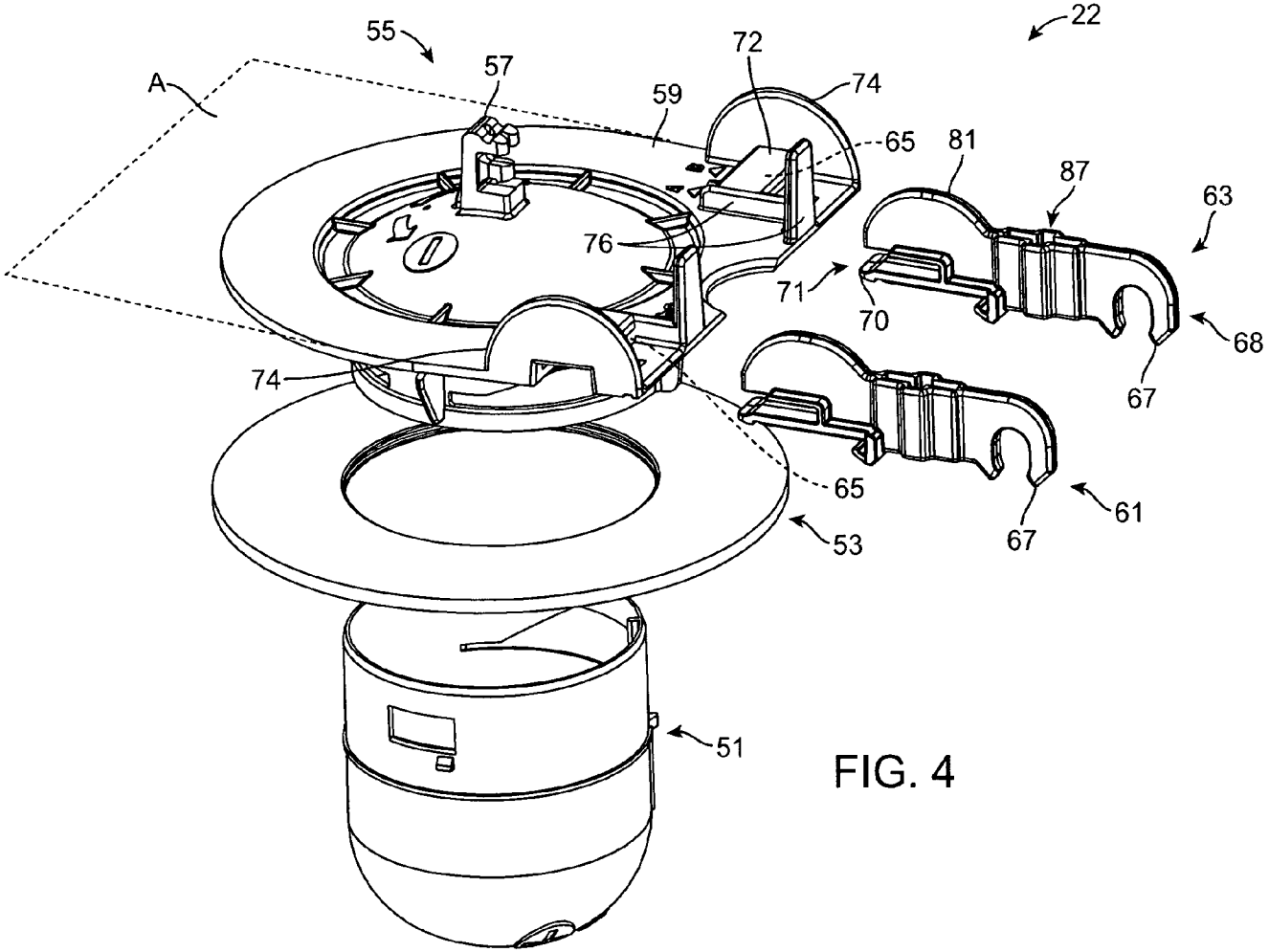
FIG. 4 is a top exploded view of a preferred embodiment of a flapper.

In FIG. 4, the preferred flapper 22 comprises a float 51 generally disposed beneath a valve seal 53. The valve seal 53 is preferably formed as a disk or ring and composed of an elastomeric material. The valve seal 53 is coupled to a bottom side of a flapper frame 55. A hook 57 disposed on top the frame 55 is configured to be coupled to a chain or other fastener.

The frame 55 preferably comprises an outer portion 59 which defines a plane A. The flapper 22 comprises a first mounting arm 61 and a second mounting arm 63 which are preferably, but not necessarily, identical in structure. In the preferred embodiment, the mounting arms 61, 63 are removably coupled to the frame 55. Each mounting arm 61, 63 is received in a corresponding groove 65 formed in the frame 55. Each mounting arm 61, 63 comprises a hook 67 at a pivot end 68 for engaging the pivot 28 and a tab 70 at an opposite frame end 71 for engaging the groove 65 in the frame 55.

It is to be expressly understood that the frame 55 may be formed with a variety of different grooves or other connecting mechanisms to removably secure the mounting arms 61, 63. In the preferred embodiment, each groove 65 may be defined by a raised surface 72 generally parallel to the plane A, an outer, or lateral, wall 74 perpendicular to the plane A, and one or more inner, or medial, walls 76 perpendicular to the plane A. Each set of lateral wall 74 and medial walls 76 defines a range of lateral movement, or adjustability, for each mounting arm 61, 63. Each groove 65 is further defined by a floor 79 which may include detents to releasably position the mounting arms 61, 63 at predetermined fixed locations.

Figure 5:
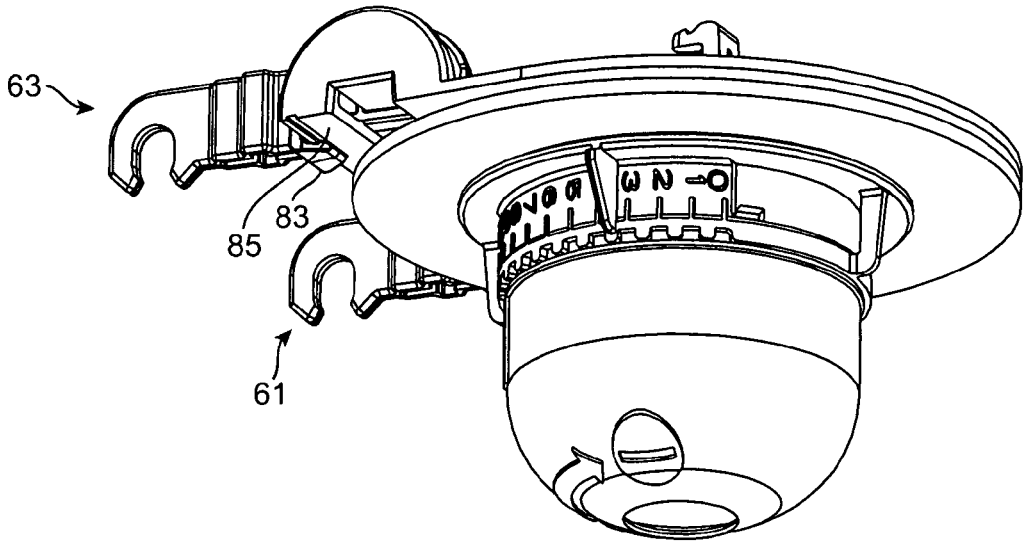
FIG. 5 is a top plan view of the preferred embodiment of the flapper.

At or adjacent to the frame end 71, each mounting arm 61, 63 may include an arm wall 81 that is perpendicular to the plane A, as shown in FIG. 4, and a clip 83, as shown in FIG. 5, for releasably engaging an indented underside 85 of the frame 55. Each mounting arm 61, 63 may also include a hollow receptacle 87 located at a central section which serves to receive a counterbalance such as a bucket float.

Figure 6:
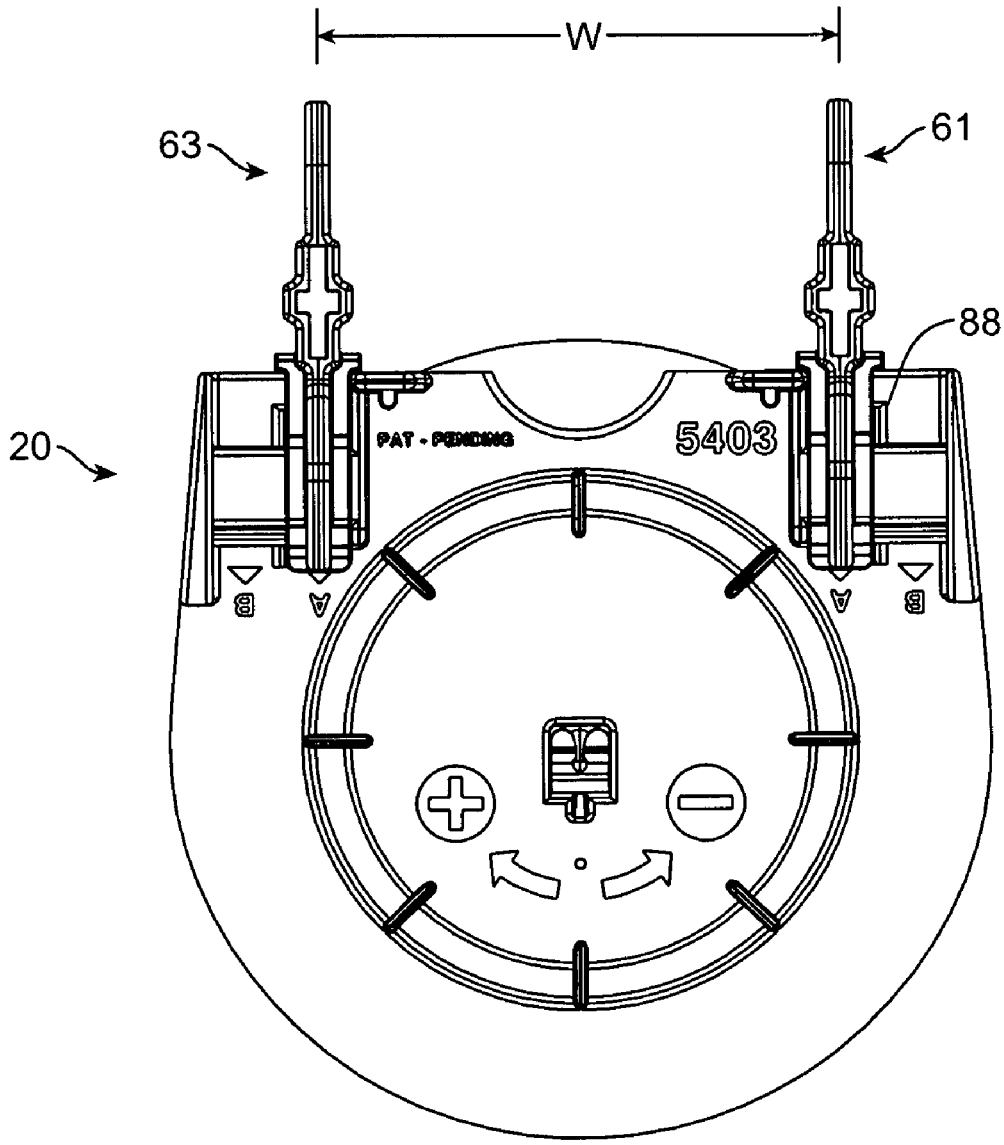
FIG. 6 is a bottom perspective view of the flapper valve assembly.

In FIG. 6, it will be appreciate that a width W between the pair of laterally movable mounting arms 61, 63 may be adjusted to accommodate overflow tubes of different sizes. Accordingly, the preferred flapper 20 may be used not only in installing a new toilet, but also in retrofitting an existing toilet. The preferred flapper 20 may thus be used in conjunction with an existing overflow tube. Detents 88 may be provided to facilitate fixed positions of the mounting arms when 61, 63.

Figure 7:
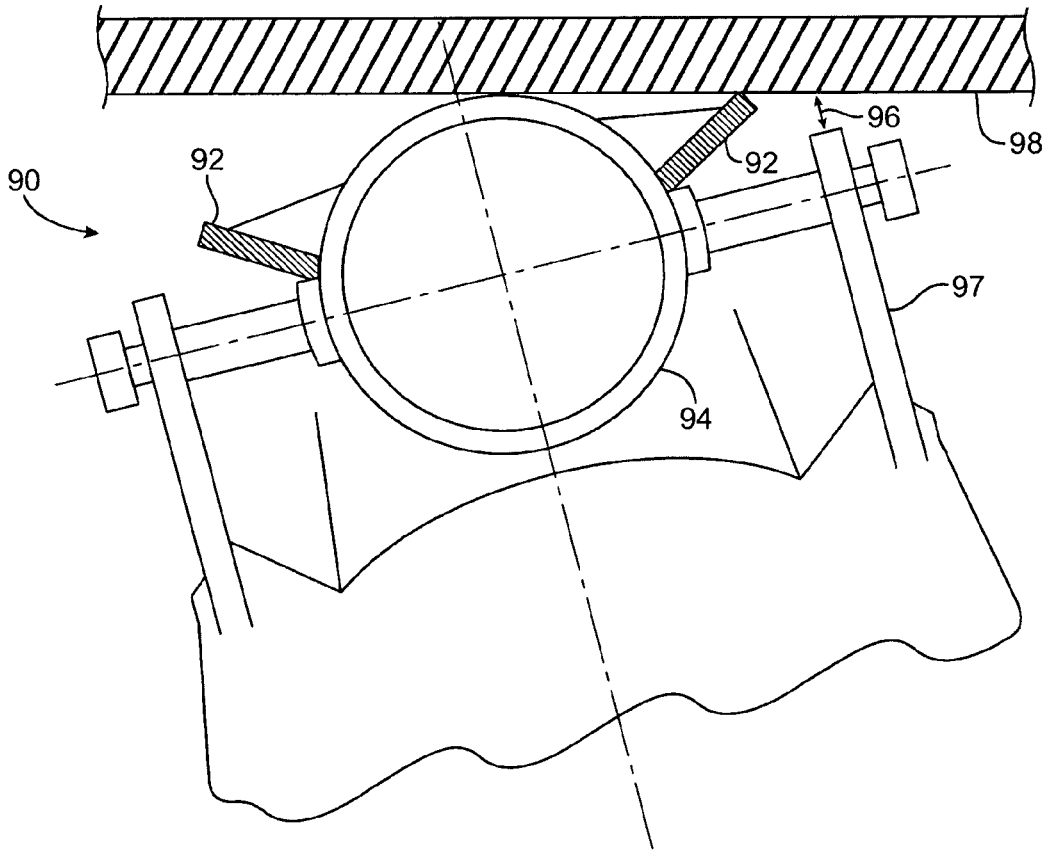
FIG. 7 is a top plan view of an alternative flapper valve body.
Figure 8:
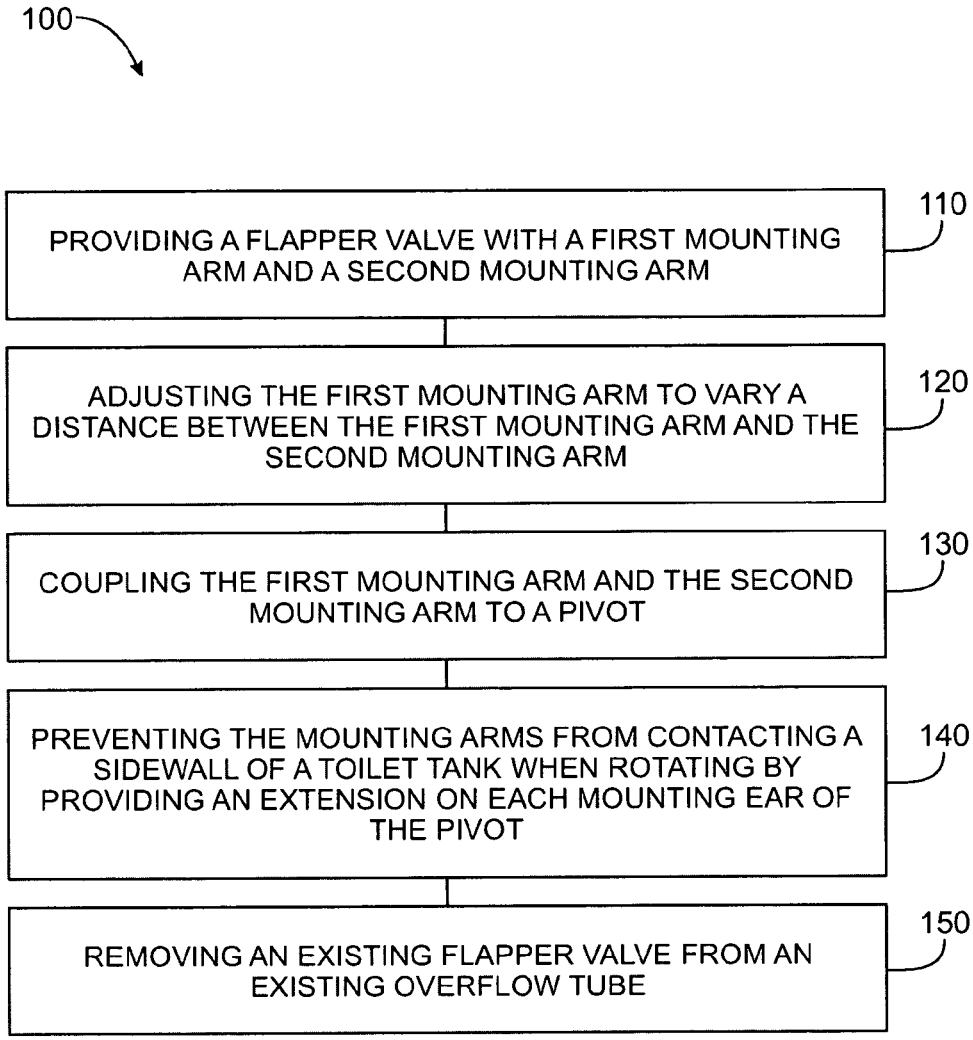
FIG. 8 is a diagram of a preferred method for installing a flush valve.

FIG. 7 is a top plan view of an alternative embodiment of a flush valve body 90. In FIG. 7, a pair of rearwardly protruding ribs 92 may be coupled to or formed as part of the overflow tube 94 so as to provide sufficient space 96 between the rotating arms 97 and the adjacent tank sidewall 98. In FIG. 8 illustrates a preferred method 100 for installing a flush valve. The method 100 comprises a step 110 of providing a flapper valve with a first mounting arm and a second mounting arm. Step 120 includes adjusting the first mounting arm to vary a distance between the first mounting arm and the second mounting arm. Step 130 includes coupling the first mounting arm and the second mounting arm to a pivot. Step 140 includes preventing the mounting arms from contacting a sidewall of a toilet tank when rotating. Step 140 may further comprise providing an extension on a mounting ear of the pivot.

The method 100 also comprises retrofitting an existing toilet tank with an existing overflow tube. In step 150, an old existing flapper valve is disengaged from the existing overflow tube and removed. Step 150 also includes coupling the new flapper valve with the adjustable mounting arm or arms onto the pivot connected to the existing overflow tube. Whereas flappers are typically sold with overflow tubes as a combined package or kit, it will be appreciated that the preferred method 100 provides a modular solution Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A flush valve assembly, comprising:

a flapper portion coupled to a pivot member and rotatable with respect to a valve seat; and a first mounting arm and second mounting arm coupled to the flapper portion and the pivot member, the first mounting arm being adjustable with respect to the second mounting arm so as to vary a distance therebetween, wherein:

the first mounting arm comprises a first tab;

the second mounting arm comprises a second tab; and the flapper portion comprises a first opening for receiving the first tab and a second opening for receiving the second tab.

2. The assembly of claim 1, wherein the flapper portion comprises a first detent for locating the first mounting in a first fixed position, and a second detent for locating the second mounting arm in a second fixed position.

3. The assembly of claim 1, wherein:

flapper portion has a top planar wall that defines a plane; and the first mounting arm is movable with respect to the second mounting arm in a direction parallel to the plane.

4. The assembly of claim 1, wherein the pivot member comprises a mounting ear having an extension.

5. A flush valve assembly, comprising:

a pivot member coupled to an overflow tube;

a flapper portion coupled to the pivot member and rotatable with respect to a valve seat;

at least one extension member coupled to the pivot member to space the flapper portion away from a vertical sidewall of a toilet tank; and a first mounting arm and second mounting arm coupled to the flapper portion and the pivot member, the first mounting arm being adjustable with respect to the second mounting arm so as to vary a distance therebetween, wherein:

the first mounting arm comprises a first tab;

the second mounting arm comprises a second tab; and the flapper portion comprises a first opening for receiving the first tab and a second opening for receiving the second tab.

6. The assembly of claim 5, wherein:

the pivot member comprises a first axle and a second axle, and the at least one extension member comprises a first mounting ear coupled to the first axle, the first mounting ear having a first extension.

7. The assembly of claim 6, further comprising a second mounting ear coupled to the second axle, the second mounting ear having a second extension.

8. A method for installing a flush valve, comprising:

providing a flapper valve with a first mounting arm and a second mounting arm wherein:

the first mounting arm comprises a first tab;

the second mounting arm comprises a second tab; and the flapper portion comprises a first opening for receiving the first tab and a second opening for receiving the second tab;

adjusting the first mounting arm to vary a distance between the first mounting arm and the second mounting arm; and coupling the first mounting arm and the second mounting arm to a pivot.

9. The method of claim 8, further comprising:

preventing the mounting arms from contacting a sidewall of a toilet tank when rotating.

10. The method of claim 9, wherein the step of preventing the mounting arms from contacting the sidewall of the toilet tank when rotating comprises:

providing an extension on a mounting ear of the pivot.

11. The method of claim 8, further comprising:

removing an existing flapper valve from an existing overflow tube; and wherein the step of coupling the first mounting arm and the second mounting arm to the pivot comprises coupling the first mounting arm and the second mounting arm to the pivot connected to the existing overflow tube.

* * * * *